United States Patent [19]

Baker et al.

[11] 4,343,658

[45] Aug. 10, 1982

[54] INHIBITION OF CARBON ACCUMULATION ON METAL SURFACES

[75] Inventors: Rees T. K. Baker, Murray Hill; James J. Chludzinski, Rahway, both of N.J.

[73] Assignee: Exxon Research & Engineering Co., Florham Park, N.J.

[21] Appl. No.: 139,843

[22] Filed: Apr. 14, 1980

[51] Int. Cl.[3] ..... C23C 9/00

[52] U.S. Cl. ..... 148/6.3; 201/41; 203/7; 208/48 R; 422/241; 422/312; 427/249; 427/295; 427/402

[58] Field of Search ..... 148/6.3; 427/228, 229, 427/249, 295, 402; 422/241, 312; 203/7; 201/2, 41; 208/48 R

[56] References Cited

U.S. PATENT DOCUMENTS

| | | | |
|---|---|---|---|
| 2,063,596 | 12/1936 | Feiler | 208/48 R |
| 2,165,253 | 7/1939 | Graves | 422/241 |
| 2,231,446 | 2/1941 | Grosse | 422/241 |
| 2,263,366 | 11/1941 | Peck et al. | 208/48 R |
| 2,354,164 | 7/1944 | Weizmann et al. | 208/48 R |
| 3,163,563 | 12/1964 | Douglass et al. | 148/39 |
| 3,379,555 | 4/1968 | Hough | 427/249 |
| 3,494,857 | 2/1970 | McIlvried et al. | 208/48 R |
| 3,560,336 | 2/1971 | Karcher | 176/192 R |
| 3,676,179 | 7/1972 | Bokros | 427/249 |
| 4,099,990 | 7/1978 | Brown et al. | 148/6.35 |
| 4,162,345 | 7/1979 | Holzl | 427/295 |
| 4,297,150 | 10/1981 | Foster et al. | 148/6.3 |

FOREIGN PATENT DOCUMENTS 1529441 10/1978 United Kingdom .

OTHER PUBLICATIONS

Baker, R. T. K., et al; "Unique Form Of Filamentous Carbon", *Nature* vol. 253, No. 5486, pp. 37–39 (1/3/75).

Renshaw, G. D., et al; "Disproportionation of CO I. Over Iron And Silicon–Iron Crystals", *Journal Of Catalysts* vol. 18 pp. 164–183 (1970).

Gregg, S. J., et al; "Reaction Of Nickel With CO at Elevated Temperatures", *Journal Of Catalysts* vol. 6 pp. 308–313 (1966).

*Metals Abstracts Index,* Abstract No. 61–0267 vol. 12, p. 170 TNIM59 (6/79).

*Primary Examiner*—Michael L. Lewis

*Attorney, Agent, or Firm*—Henry E. Naylor

[57] ABSTRACT

Metal substrate surfaces are protected against carbon accumulation when exposed to an environment wherein carbon-containing gases are decomposed. The protection is accomplished by the use of tantalum and/or tungsten entities deposited and/or diffused into the surface of the substrate.

8 Claims, No Drawings

INHIBITION OF CARBON ACCUMULATION ON METAL SURFACES

BACKGROUND OF THE INVENTION

1. Field of the Invention

The present invention relates to the use of tungsten and/or tantalum or compositions thereof, for inhibiting the accumulation of carbon on metal surfaces subjected to environments in which the decomposition of carbon-containing gases occurs.

2. Discussion of the Prior Art

Metal surfaces, especially those containing iron, nickel, chromium, cobalt, molybdenum, and alloys and combinations thereof, are prone to the accumulation of both filamentous and amorphous carbon when subjected to high temperature reactions involving carbon-containing materials, e.g., hydrocarbons and carbon monoxide. Examples of such reactions, which are of commercial importance, are the production of ethylene by cracking, the production of motor fuels from petroleum sources by conversion of heavy feedstocks, the production of vinyl chloride from dichloroethane and the production of CO and $H_2$ by steam-reforming of hydrocarbon feed stock over a nickel-supported catalyst. Such reactions are generally accompanied by the accumulation of carbon on the surfaces of the reaction tubes in contact with the reaction medium. This accumulation of carbon in the reaction tubes causes a restricted flow of the reaction material and reduced heat transfer from the reaction tube to the reaction medium. It also causes damage to the inner surface of the tube owing to carburization and frequent exposure to the carburization/oxidation cycle also accelerates corrosion, both of which reduce reactor life expectancy. The reduction in heat transfer necessitates raising the reaction tube temperature to maintain a constant gas temperature and production rate.

Various methods have been employed to inhibit the accumulation of carbon. Such conventional methods include steam pre-treatment of the metal reactor inner-surface to promote formation of a protective oxide film. Also, sulfur compounds are added to the process gases to poison active nickel sites and to scavenge free radical precusors of amorphous carbon. However, the rate of carbon accumulation can still be rapid under high severity conditions.

Other methods taught in the prior art include the process, taught in U.S. Pat. No. 4,099,990, for forming protection films on nickel, chromium or iron alloy substrates susceptible to coke formation. The process consists of first preoxidizing the substrate surface, then depositing thereon a layer of silica by thermally decomposing an alkoxysilane vapor.

Another method is that taught in U.K. Pat. No. 1,529,441 wherein protective films are formed on a substrate of an iron, nickel or chromium, or alloy thereof. The protective film is applied by first depositing on the substrate surface a layer of another metal such as aluminum, iron, chromium or molybdenum by vaporization and then rendering this deposited layer insert by treatment with steam or a silicon compound.

Heat-exchangers in nuclear reactors can be protected against carbon deposits by use of certain volatile silicon compounds such as dichlorodiethylsilane. See U.S. Pat. No. 3,560,336.

Although many of these conventional methods have met with varying degrees of commercial success, there is still a need in the art for developing methods for protecting against the accumulation of carbon without adversely affecting the metal substrate. For example, although silicon compounds have proved commercially successful for protecting certain metal surfaces against the accumulation of carbon, there is still the possibility of an excess amount of silicon adversely affecting the properties of the metal substrate.

SUMMARY OF THE INVENTION

In accordance with the present invention, there is provided a method for protecting a metal surface against carbon accumulation wherein the metal surface is one which is susceptible to carbon accumulation when exposed to an environment wherein carbon-containing gases are decomposing. The method is comprised of (a) depositing, on the metal surface, one or more materials selected from the group consisting of tungsten, tantalum, or a compound which will decompose at the temperature at which the metal surface is heated in (b) below to leave on the surface one or more materials selected from the group consisting of tungsten, tantalum, or an oxide thereof. The substrate is then heated to a temperature of from 600° C. to 1200° C. for an effective amount of time so that the growth of carbon filaments on the substrate surface is inhibited by a factor of at least four, relative to an unprotected surface of the same substrate when exposed to an environment wherein carbon-containing gases are decomposing.

In preferred embodiments of the present invention the metal can be one selected from the group consisting of iron, nickel, chromium, cobalt, molybdenum, or alloys thereof.

DETAILED DESCRIPTION OF THE INVENTION

Metal surfaces containing iron, nickel, chromium, cobalt, molybdenum, and alloys and combinations thereof, are subject to carbon accumulation when exposed to environments in which the decomposition of carbon-containing gases occurs. This accumulated carbon is generally composed of filamentous carbon and amorphous carbon. Although not wishing to be limited by theory, it is believed that the carbon filaments are formed by the metal-catalyzed decomposition of carbon-containing gas. It is believed that carbon diffuses through the metal particle from the hotter leading face on which the decomposition of the carbon-containing material occurs to the cooling trailing faces at which carbon is deposited from solution. Carbon remaining at the leading particle surfaces diffuses around the particle to constitute the wall of the filament. It is believed filament growth ceases when the leading face is covered with a layer of carbon build up as a consequence of rate control by the carbon diffusion process. In other words, particles of metal such as iron and nickel, originating from the metal substrate, catalyze the formation of filamentous carbon. The filamentous carbon provides a large surface area for the collection of amorphous carbon which fills the voids between filaments, thereby producing a compact carbon structure. Therefore, if the growth of filamentous carbon can be inhibited, the build-up of amorphous carbon can be reduced, thereby substantially reducing the total carbon accumulation on the metal surface exposed to the decomposition of carbon-containing gases.

Of course, if the carbon filaments are allowed to grow unchecked, the greater the amount of carbon accumulation which, in the case of tubular reaction tubes, causes a reduction of the flow of reactants and a reduction of the heat transfer from the metal substrate to its environment. When this occurs, the temperature of the reaction tube must be increased in direct proportion to the accumulation of carbon in order to maintain a constant temperature of the reaction medium as well as a constant rate of production of the desired product.

The inventors herein have surprisingly discovered that both tungsten and tantalum, or a combination thereof, will inhibit the growth of carbon filaments, by a factor of at least four, on metal material having a tendency to catalyze and grow filamentous carbon. These metal materials can be characterized as having a high solubility for carbon and allow such carbon to diffuse through them. Non-limiting examples of such metal materials include iron, nickel, chromium, cobalt, molybdenum and combinations and alloys thereof. Non-limiting examples of metal alloys which can be protected by the present invention include alloys such as mild steel as well as high and low alloy steels. Especially included are the alloys or superalloys used (a) in tubular reactors for the conversion of hydrocarbons and the production of vinyl chloride from dichloroethane, and (b) in heatexchangers in modern gas-cooled reactors, such as nuclear reactors. Such alloys ordinarily contain iron, nickel and chromium. Examples of commercially available alloys which can be protected, by use of the present invention, against carbon accumulation include the high-alloy steels sold under the names Inconel, Incoloy, and AISI3IO/HK 40 steel. Other stainless steels of lesser quality, such as alloys of 321, 304 and 316 types, can also be protected by use of the present invention.

Although not wishing to be limited hereby, it is believed that the tungsten and/or tantalum of the treated metal surfaces prevents the absorption and decomposition of carbon-containing gases on the potentially active catalytic metallic entities. It is also within the scope of the present invention to protect the surface of metals which do not ordinarily provide catalytic sites for filamentous carbon formation. This can be accomplished by depositing a film of tungsten oxide and/or tantalum oxide onto the metal substrate to be protected. This oxide film creates a protective physical barrier on the substrate surface, thereby inhibiting the accumulation of amorphous carbon.

The substrate surfaces can be treated in accordance with the present invention in a variety of methods. In general, any method employed to protect such surfaces will involve the deposition of a material onto the surface of the substrate such that at elevated temperatures tungsten and/or tantalum entities or their oxides are present on the substrate surface. By elevated temperatures we mean temperatures from about 600° C. to about 1200° C.

One preferred method of practicing the present invention is to evaporate, preferably in a vacuum, tungsten and/or tantalum onto the substrate surface to be treated, the substrate surface being preferably at a temperature less than about 100° C. The treated surface is then heated to a temperature from about 600° C. to about 1200° C., preferably about 700° C. to about 900° C.; in an oxidizing, reducing, or neutral environment, preferably an oxidizing environment; for an effective amount of time. By effective amount of time we mean an amount of time long enough so that enough of the tungsten and/or tantalum entity diffuses into the surface of the substrate so that when the substrate is exposed to a carbon-containing gaseous decomposition atmosphere, the subsequent growth of carbon filaments on the substrate surface will be inhibited by a factor of at least four, when compared with an unprotected surface of the same substrate material exposed to the same atmosphere.

Another method which can be employed in practicing the present invention is to first deposit a tungsten and/or tantalum oxide film on the substrate surface. Again, it is preferred that the substrate surface be at a temperature of less than about 100° C. during this initial step. The substrate surface is then heated as above to a temperature from about 600° C. to about 1200° C., preferably about 700° C. to about 900° C., in a reducing atmosphere, for an effective amount of time as above. It is believed that heating by this method decomposes the oxide and drives the resulting metallic entities into the substrate surface.

Still another method of practicing the present invention is to deposit a tungsten and/or tantalum composition on the substrate surface to be treated. Again, the substrate surface is preferably at a temperature of less than about 100, C. As in the above described methods, the treated substrate is heated to a temperature from about 600° C. to 1200° C. for an effective amount of time; also as described above. It is important that the particular composition employed be one which will decompose to give tungsten and/or tantalum entities when the treated substrate is heated to the temperature at which the entities are driven into the substrate surface. This method is particularly preferred when the inner surfaces of reactor tubes are to be treated.

Non-limiting examples of tungsten and tantalum compositions suitable for use herein include salts such as ammonium metatungstate, tungsten hexachloride, tantalum bromide, tungsten dibromide, and tantalum pentachloride. Also suitable for use herein are such compounds as tantalum ethoxide and tungstoslicic acid.

The amount of accumulated carbon on the surface of the substrate can be determined by any conventional method used for such purposes and is within scope of those having ordinary skill in the art. Examples of such conventional methods include simply measuring the increase in weight of the substrate after exposure to a carbon-decomposition atmosphere or by reacting the accumulated carbon with oxygen at about 650° C., thereby converting the carbon to carbon dioxide, which can then be readily measured.

The following examples serve to more fully describe the manner of making and using the above-described invention, as well as to set forth the best modes contemplated for carrying out various aspects of the invention. It is understood that these examples in no way serve to limit the true scope of this invention, but rather, are presented for illustrative purposes.

COMPARATIVE EXAMPLES A TO C

Three metals substrates comprised of 50 wt.% iron and 50 wt.% nickel were used for these examples. Sample A remained untreated. Sample B was treated by vacuum evaporating, at room temperature (25° C.), metallic aluminum thereon, and sample C was treated by vacuum evaporating thereon, also at room temperature, metallic titanium. The volume % of titanium and aluminum evaporated onto the respective substrate were approximately equal; that is, enough of each was evaporated to give from 5 to 10 monolayers on the substrate surface. Both samples (B and C) were then heated for 60 minutes, at 850° C., in flowing oxygen, at a pressure of 5 Torr.

All three samples were placed in a gas reaction cell of an electron microscope and heated from room temperature to 1000° C. in a 1 mm flowing acetylene gas stream. Filamentous carbon was observed to have commenced forming at varying temperatures, depending on the treatment of the sample. The rate of filamentous carbon growth at 850° C. was also measured and the results of both onset of carbon filament growth and growth rate at 850° C. is set forth in Table I below.

EXAMPLES 1 and 2

Two substrate samples of identical type (50% iron/50% nickel) as used in the above comparative examples were treated by vacuum evaporating tungsten on one substrate (1) and tantalum on the other substrate (2); both substrates were at room temperature. After evaporation, both substrates were heated for 60 minutes at 850° C., in flowing oxygen, at a pressure of 5 mm. Again as in the comparative examples, enough of the evaporated metal was deposited on the respective to give from about 5 to 10 monolayer coverage. The temperature at which filamentous carbon growth commenced and its rate of growth at 850° C. were measured; the results are set forth in Table I below.

TABLE I

| Example | Additive | Onset[1] Temp. °C. | Rate of Filament Growth at 850° C. (nm. $s^{-1}$) |
|---|---|---|---|
| Comp. A | virgin Ni—Fe | 480 | 413 |
| Comp. B | Al | 650 | 428 |
| Comp. C | Ti | 635 | 220 |
| 1 | W | 700 | 12.6 |
| 2 | Ta | 680 | 34.7 |

[1]Temperature at which filamentous carbon started to grow.

The above table illustrates the usefulness of tungsten and tantalum for inhibiting the growth of filamentous carbon. Aluminum apparently has no inhibiting effect on filamentous carbon while titanium exhibited a limited inhibiting effect. Not only was the rate of filament growth retarded by tungsten and tantalum, but the substrates which contained tungsten and tantalum evidenced the onset of carbon filament growth at higher temperatures relative to the virgin substrate or those treated with aluminum or titanium.

EXAMPLES 3 and 4

Two coupons of high purity nickel foil were treated, one with tungsten and the other with tantalum, according to the evaporation procedure set forth in the previous examples. Both of these coupons as well as an untreated coupon were preheated in air at 800° C. for 1 hour then exposed to 1 atmosphere of flowing ethane at 700° C. for 1 hour. The weight of carbon accumulation was measured and the results are shown in Table II below.

TABLE II

| Exaple | Coupon | Avg. Wt. of Carbon ($g \times 10^{-4}/cm^2$) | Relative To Virgin |
|---|---|---|---|
| — | virgin nickel | 124.3 | 100 |
| 3 | W/nickel | 33.1 | 26.6 |
| 4 | Ta/nickel | 45.1 | 36.3 |

The above table illustrates that tungsten and tantalum are useful for inhibiting carbon accumulation on a metal surface which is susceptible to carbon accumulation when exposed to an environment in which the decomposition of carbon-material occurs. This accumulated carbon represents both filamentous carbon and amorphous carbon.

COMPARATIVE EXAMPLES D AND E

Two coupons of 310 stainless steel, one having aluminum evaporated thereon and the other having titanium evaporated thereon (which evaporation procedure was the same as set forth in the above examples) were pretreated in air at 800° C. for 1 hour then exposed to 1 atmosphere flowing ethane at 700° C. for 1 hour. The amount of carbon accumulation was measured and the results are set forth in Table III below.

EXAMPLES 5 and 6

Two coupons of 310 stainless steel were treated according to comparative Examples D and E above except on one coupon tungsten was evaporated and on the other tantalum. The amount of carbon accumulation was measured and the results are set forth in Table III below.

TABLE III

| Example | Coupon | Avg. Wt. of Carbon $g \times 10^{-4}/cm^2$ | Relative to Virgin |
|---|---|---|---|
| — | virgin 310-SS | 46.59 | 100 |
| Comp. D | Al/310-SS | 28.17 | 60.46 |
| Comp. E | Ti/310-SS | 22.64 | 48.59 |
| 5 | W/310-SS | 8.40 | 18.03 |
| 6 | Ta/310-SS | 10.557 | 22.65 |

The above table illustrates the effectiveness of tungsten and tantalum for inhibiting the accumulation on stainless steel subjected to conditions of carbon accumulation. The carbon accumulation in these examples also represent both filamentous and amorphous carbon.

In all examples herein, enough material was evaporated on the metal substrate so as to give a 5 to 10 monolayer covering.

As can be seen by the examples herein, tungsten and tantalum act to inhibit the growth of filamentous carbon which in turn prevents the accumulation of amorphous carbon. That is the reduction of the carbon filament network reduces the number of accumulation sites for amorphous carbon. Therefore, total carbon accumulation is reduced.

What is claimed is:

1. A method for protecting one or more surfaces of a metal substrate against carbon accumulation wherein the metal surface is one which is susceptible to carbon accumulation when exposed to an environment wherein carbon-containing gases are undergoing decomposition, which method comprises:

(a) depositing, on the metal substrate surfaces to be protected, one or more materials selected from the group consisting of tungsten, tantalum, or a compound which will decompose at the temperature at which the metal substrate is heated in (b) below, to leave tungsten or tantalum on the metal substrate; and (b) heating the metal substrate to a temperature of from about 600° C. to 1200° C., in an oxidizing atmosphere, for an effective amount of time, thereby driving tungsten and/or tantalum into the substrate surface, so that the growth of carbon filaments on the substrate surface is inhibited by a factor of at least four, relative to an unprotective surface of the same substrate, when the substrate is exposed to an environment wherein carbon-containing gases are undergoing decomposition, (c) and after step (b) exposing the protected substrate surfaces to a carbon accumulating environment.

2. The method of claim 1 wherein the metal substrate is comprised of one or more of the metals selected from the group consisting of iron, nickel, chromium, cobalt, molybdenum, or alloys thereof.

3. The method of claim 2 wherein the alloy is a stainless steel.

4. The method of claim 1 wherein the metal substrate is a reaction tube.

5. The method of claim 4 wherein the reaction tube is a stainless steel reactor tube.

6. The method of claim 1 wherein the material is tungsten or tantalum.

7. The method of claim 6 wherein the tungsten or tantalum is deposited on the metal substrate by vacuum evaporation.

8. The method of claim 1 wherein the temperature to which the substrate is heated in (b) is about 700° C. to about 900° C.

* * * * *